US011486201B2

(12) United States Patent
Kuang et al.

(10) Patent No.: US 11,486,201 B2
(45) Date of Patent: Nov. 1, 2022

(54) FIXED CUTTING STRUCTURE-COMPOSITE CONE DRILL BIT

(71) Applicants: CHENGDU HAIRUI ENERGY TECHNOLOGY CO., LTD, Sichuan (CN); SOUTHWEST PETROLEUM UNIVERSITY, Sichuan (CN)

(72) Inventors: Yuchun Kuang, Sichuan (CN); Qin Wang, Sichuan (CN); Lian Chen, Sichuan (CN); Zhiming Shi, Sichuan (CN)

(73) Assignees: CHENGDU HAIRUI ENERGY TECHNOLOGY CO., LTD, Sichuan (CN); SOUTHWEST PETROLEUM UNIVERSITY, Sichuan (CN)

( * ) Notice: Subject to any disclaimer, the term of this patent is extended or adjusted under 35 U.S.C. 154(b) by 0 days.

(21) Appl. No.: 17/044,776

(22) PCT Filed: Jul. 4, 2019

(86) PCT No.: PCT/CN2019/094711

§ 371 (c)(1),
(2) Date: Oct. 1, 2020

(87) PCT Pub. No.: WO2020/007343

PCT Pub. Date: Jan. 9, 2020

(65) Prior Publication Data

US 2021/0108465 A1 Apr. 15, 2021

(30) Foreign Application Priority Data

Jul. 5, 2018 (CN) ..... 201810731452.5

(51) Int. Cl.
*E21B 10/16* (2006.01)
*E21B 10/43* (2006.01)
(Continued)

(52) U.S. Cl.
CPC ..... *E21B 10/16* (2013.01); *E21B 10/14* (2013.01); *E21B 10/43* (2013.01); *E21B 10/22* (2013.01); *E21B 17/1092* (2013.01)

(58) Field of Classification Search
CPC ..... E21B 10/14; E21B 10/16; E21B 10/22; E21B 10/43; E21B 17/1092
See application file for complete search history.

(56) References Cited

U.S. PATENT DOCUMENTS 1,143,273 A * 6/1915 Hughes ..... E21B 10/12 175/339
1,327,913 A * 1/1920 Hughes ..... E21B 10/10 175/364
(Continued)

FOREIGN PATENT DOCUMENTS

CN 102392603 A 3/2012
CN 102392605 A 3/2012
(Continued)

*Primary Examiner* — Blake Michener
(74) *Attorney, Agent, or Firm* — Novick, Kim & Lee, PLLC; Allen Xue

(57) ABSTRACT

A fixed cutting structure-composite cone drill bit includes a drill bit body, a fixed cutting structure, and at least one cone. The cone and the fixed cutting structure are disposed on the drill bit body. The cone is rotatably connected to the drill bit body by means of a bearing structure. The distance from the outermost tooth or back cone of the at least one cone to the front side surface of the fixed cutting structure $La \leq \pi R/3$, and the distance from the outermost tooth or back cone of the at least one cone to the rear side surface of the fixed cutting structure $Lb \leq \pi R/3$. In the composite drill bit, the distance from the cone to the front/rear side surface of the fixed cutting structure is short, the gap between the cone and the fixed cutting structure is small, transition between cutting structure is smooth.

10 Claims, 2 Drawing Sheets

(51) Int. Cl.

| | |
|---|---|
| ***E21B 10/14*** | (2006.01) |
| ***E21B 10/22*** | (2006.01) |
| *E21B 17/10* | (2006.01) |

(56) References Cited

U.S. PATENT DOCUMENTS

| | | | | |
|---|---|---|---|---|
| 1,348,419 | A * | 8/1920 | Hughes | E21B 10/10 175/339 |
| 4,359,112 | A * | 11/1982 | Garner | E21B 10/60 175/428 |
| 4,386,669 | A * | 6/1983 | Evans | E21B 10/14 175/269 |
| 4,444,281 | A | 4/1984 | Schumacher et al. | |
| 9,353,575 | B2 * | 5/2016 | Zahradnik | E21B 10/18 |
| 2010/0155145 | A1 | 6/2010 | Pessier et al. | |
| 2010/0155146 | A1 * | 6/2010 | Nguyen | E21B 10/22 175/336 |
| 2010/0288561 | A1 * | 11/2010 | Zahradnik | E21B 10/00 175/336 |
| 2011/0024197 | A1 * | 2/2011 | Centala | E21B 10/08 175/353 |
| 2013/0126247 | A1 * | 5/2013 | Yang | E21B 10/50 175/374 |
| 2013/0313021 | A1 * | 11/2013 | Zahradnik | E21B 10/28 175/57 |
| 2014/0353046 | A1 * | 12/2014 | Zhang | E21B 10/14 175/331 |
| 2016/0319602 | A1 * | 11/2016 | Zhang | E21B 10/24 |
| 2016/0348440 | A1 * | 12/2016 | Gan | E21B 10/08 |

FOREIGN PATENT DOCUMENTS

| | | | |
|---|---|---|---|
| CN | 106121541 | A | 11/2016 |
| CN | 106437525 | A | 2/2017 |
| CN | 107605407 | A | 1/2018 |
| CN | 208564440 | U | 3/2019 |
| WO | 2010132232 | A4 | 11/2010 |

* cited by examiner

FIXED CUTTING STRUCTURE-COMPOSITE CONE DRILL BIT

TECHNICAL FIELD

The invention belongs to the technical field of drilling equipment such as petroleum and natural gas, mining engineering, geothermal, building foundation engineering construction, geology, hydrology, etc., and particularly relates to a composite drill bit.

BACKGROUND OF THE TECHNIQUE

The drill bit is a rock-breaking tool used in the drilling engineering to break the rock and form a wellbore. The cutting structure of the bit determines its performance and affects the rock-breaking efficiency and service life of the bit.

PDC bits (polycrystalline diamond compact bits) and tricone bits are commonly used in drilling engineering. The PDC cutter breaks the rock by scraping and cutting. After the PDC cutter penetrates the rock, it is driven by the rotation of the bit body to form a cutting action on the rock. When the drill bit has large working vibration and poor working stability, the cutter of the PDC bit is very easy to collapse and lose efficiency. PDC bits are also easy to cause the cutting teeth of the drill to fail during directional drilling, which reduces the drilling capacity of the drill and shortens the service life of the drill bit. The tricone bit is mainly used to break rock by impact crushing. Its disadvantage is that the energy utilization rate is low, the rock-breaking efficiency is low, and the bearing is subjected to large impact and the dynamic load coefficient is large during the working process.

Baker Hughes Corporation of the United States proposed a hybrid bit (patent applications have been filed in the United States and other countries, such as PTC W02010/132232, etc.), which is a combination of a fixed cutting structure and a cone cutting structure. When the drill bit rotates, the PDC cutter on the fixed cutting structure (fixed blade) breaks the rock by scraping; the cone cutting structure of the hybrid bit is similar to the composite cone drill bit, and the cone teeth are mainly used to break rock by impact crushing. Due to the different rock breaking working principles of the two cutting structures, the drill bit has a special structure, and the drill bit is complex when working with a hybrid bit, and the bit working conditions are also complex. The working stability of the hybrid bit often affects the service life and performance of the bit. The unstable operation of the drill bit and the complex working conditions of the hybrid drill bit often causes abnormal failures such as the breakage of the PDC cutter on the drill bit, which significantly reduces the drilling speed and service life of the drill bit, and causes damage to the downhole drill motor and drill string and other security issues. In addition, the hybrid bit also has good guide performance in directional drilling. However, due to the transition and spatial discontinuity between the PDC on the bit and the cone cutting structure, the bit will become unstable during directional drilling. The damage to the cutting structure of the drill bit also affects the frequent changes of the tool surface of the drill bit, which is not easy to control, seriously affects the directional performance of the drill bit, and reduces the efficiency and economy of the drill bit in directional drilling. At the same time, the discontinuous transition between the PDC and the cone cutting structure also affects the force of the cone. There is a large gap between the cone and the PDC cutting structure. When the bit breaks the rock, the transition from the PDC to the cone makes the cone sudden changes in load and greater impact affect the service life and safety of the cone. Especially in the directional drilling and the drilling of uneven layers, the problem is more prominent.

SUMMARY OF THE INVENTION

The purpose of this invention is to provide a fixed cutting structure-composite cone drill bit with a relatively continuous transition between a fixed cutting structure and a cone, and high working stability, so as to solve the problems of poor working stability and low orientation performance of drill bit in the prior art, and improve the working stability, drilling efficiency and service life of the drill bit.

The purpose of the invention is realized by the following technical options:

A fixed cutting structure-composite cone drill bit, comprising a bit body, a fixed cutting structure, and at least one cone. The cone and the fixed cutting structure are disposed on the bit body, and the cone forms a rotational connection with the bit body through a bearing structure. The distance La between the outermost tooth or back cone of at least one cone and the front side surface of the fixed cutting structure is less than or equal to $\pi R/3$, that is, $La \leq \pi R/3$. And the distance Lb between the outermost tooth or back cone of at least one cone to the rear side surface of the fixed cutting structure is less than or equal to $\pi R/3$, that is, $Lb \leq \pi R/3$ (R is the radius of the drill bit).

The front side surface of the fixed cutting structure described in this invention refers to the front side surface of the fixed cutting structure when the drill bit rotates, that is the front surface of the cutting structure when the cutting structure moves relative to the rock (the front side surface 21 of the fixed cutting structure as shown in FIG. 1 and FIG. 2), which is similar to the meaning of the rake face when the tool cuts metal in metal cutting. The backside of the fixed cutting structure described in this invention refers to the back surface of the fixed cutting structure, that is, the back of the front side surface (the backside surface 22 of the fixed cutting structure in FIG. 1 and FIG. 2).

The outermost tooth of the cone mentioned in this invention refers to the outermost cutting teeth on the cone (farthest from the center of the bit). The cutting teeth on the cone are often disposed on the cone in a circle. The outermost cutters of the cone are also the cutters on the outermost row of the gauge tooth of the cone (the cutter 31 on the outermost row of the gauge tooth on the cone as shown in FIG. 1 and FIG. 2). The back cone of the cone refers to the back cone of the cone (as shown in FIG. 2 for the back cone 32 of the cone).

When the drill bit is drilling, the drill bit is rotated by the rotation of the drill string to break the rock under the action of the weight on the bit. Due to the needs of expelling cuttings, etc., the cutting structure on the drill bit is generally provided with flow channels, and the cutting structure of the drill bit is not continuous in the circumferential direction. Due to the circumferential discontinuity of the cutting structure, the drill bit is prone to vibration when working at the bottom of the well, which increases the instability of the drill bit. The larger the gap between the cutting structures of the drill bit, the worse the working stability of the drill bit is, and the cutting teeth on the cutting structure of the drill bit are more easily damaged under unstable operation and vibration of the drill bit. Especially in directional drilling, because the bit is pushed/pointed to a certain direction of the borehole wall, the bit deviates from the center of the borehole to perform sidecut drilling on the borehole wall and the transition area between the bottom and the borehole wall, and the bit transitions from a cutting structure. When the sidewall of the well is cut to another cutting structure, the gap between the cutting structures causes the cutting teeth on the cutting structure to impact. The larger the gap between the cutting structures, the greater the impact on the cutting teeth, the easier the cutting teeth are damaged, and the shorter the drill life.

The composite drill bit is composed of a fixed cutting structure and a cone cutting structure. The rock breaking has both the scraping and breaking of the cutting teeth on the fixed cutting structure and the punching and breaking of the cone. The combination of the two rock breaking methods makes the working mechanics and working conditions of composite drill bits are more complicated, which are different from the working characteristics and working conditions of conventional PDC bits, and also different from the characteristics and working conditions of ordinary tricone bits. The composite drill bit is equivalent to adding a cone on the PDC bit. The cone has the effect of assisting the PDC cutter to break the rock, but it also makes the working conditions of the PDC cutter and the bit more complicated. During the transition from punching and breaking rock to scraping and breaking rock of the PDC cutter, the PDC cutter is often damaged. Especially in directional drilling, when the drill bit sidecuts the well wall, the punching sidecut with cones is transformed into the scraping sidecut of the PDC cutter, and the sudden changes will cause the impact damage of the PDC cutter. In directional drilling, damage to the outer shoulder and gauge protection of the drill bit is a common failure form of the composite drill bit, and it is also one of the shortcomings of the composite drill bit.

On the other hand, the cone is a non-fixed cutting structure that can rotate relative to the bit body, and the cone has a bearing and a sealing system. The transition from the scraping of the fixed cutting structure to the punching of the cone changes the working conditions and load of the cone. The greater the distance and the gap (empty) between the cone and the fixed cutting structure, the load on the cone. And the greater the impact change, the more complex and harsh the working conditions of the cutting teeth on the cone and the bearing sealing system in the cone, and the lower the service life.

In order to overcome the shortcomings of the composite drill bit, this invention proposes that the distance La between the outermost tooth or back cone of the cone and the front side surface of the fixed cutting structure, that is $La \leq \pi R/3$, and the distance Lb from the outermost tooth or back cone of the cone to the rear of the fixed cutting structure, that is $Lb \leq \pi R/3$ (R is the radius of the drill). This significantly reduces the distance between the cone and the fixed cutting structure in front/rear, and reduces the gap (empty) between the cone and the fixed cutting structure.

The beneficial effects of this invention over the prior art are as follows:

1. The distance between the cone and the front/the rear side surface of the fixed cutting structure is small, and the gap between the cone and the fixed cutting structure is small, which makes the transition from the cone to the fixed cutting structure more stable, and the drill bit has high working stability and reduces the vibration of bits during rock-breaking drilling that makes the bit work smoothly, reducing impact damage to the cutting teeth of the bit. Therefore, this invention can prolong the service life of the drill bit.

2. When the bit is directional drilling, the smaller the distance between the cone and the fixed cutting structure can improve the cutting (rock breaking) transition between the cone and the fixed cutting structure, and reduce the impact and cutting mutation during the transition between cutting structures. It is beneficial to reduce the damage of the cutting teeth, and is beneficial to the control of the drill bit orientation tool surface. The smaller the transition distance between the cutting structures, the smaller the torque fluctuation of the drill bit, the easier the tool surface is to control, and the better the drill bit guiding performance. Therefore, this invention can significantly improve the orientation performance and orientation service life of the drill bit.

3. The distance between the cone and the front/the rear side surface of the fixed cutting structure is small, the transition distance between the cone and the fixed cutting structure is small, and the rock-breaking transition between the bit cutting structures is smooth, which is beneficial to reduce the load and impact of the cone teeth and bearing. And it can significantly increase the service life of the cone and the service life of the drill bit.

4. The distance between the cone and the front/the rear side surface of the fixed cutting structure is small, which can improve the working stability of the drill bit. The borehole drilled by the drill bit is more regular, the quality of the well wall is good, which can significantly improve the safety of drilling, and can provide good conditions for subsequent logging and cementing.

As an option, the fixed cutting structure is provided with fixed cutting teeth, and the fixed cutting teeth may be PDC cutter, PDC teeth, impregnated diamond bit teeth (or blocks), cubic boron carbide, ceramic teeth, hard alloy teeth.

As an option, the distance La from the outermost tooth or back cone of the cone to the front side surface of the fixed cutting structure is less than or equal to $\pi R/4$, that is, $La \leq \pi R/4$. As a further option, the distance La from the outermost tooth or back cone of the cone to the front side surface of the fixed cutting structure is less than or equal to $\pi R/5$ (ie $La \leq \pi R/S$), and less than or equal to $\pi R/6$ (ie $La \leq \pi R/6$).

Preferably, the distance Lb from the outermost tooth or back cone of the cone to the rear side surface of the fixed cutting structure is less than or equal to $\pi R/4$, that is, $Lb \leq \pi R/4$. As a further preference, the distance Lb from the outermost tooth or back cone of the cone to the rear side surface of the fixed cutting structure is less than or equal to $\pi R/5$ (that is, $Lb \leq \pi R/5$), and less than or equal to $\pi R/6$ (that is, $Lb \leq \pi R/6$). The continuity between the outer circumferential cutting structures of the drill bit has a greater impact on the stability of the drill bit than the inner cutting structure. The closer the transition of the cutting structure in the outer area of the drill bit, the smoother the transition between the drill bit cutting structures and the stable operation of the drill bit. The better the performance, the better the orientation performance and the longer the service life.

As an option, the cutting profile of the fixed cutting structure, whose the distance from the front side surface to the outermost tooth or back cone of the cone is less than or equal to $\pi R/3$, $\pi R/4$, $\pi R/5$ or $\pi R/6$ does not extend to the center of the drill bit. The structure of the composite drill bit is more complex and compact, and the drill bit core space is small. It is difficult to set the hydraulic structure of the drill bit. The cutting contour of the fixed cutting structure close to the cone does not extend to the center of the drill bit, which can provide sufficient water holes for the inner area of the drill bit. Hydraulic structure installation space. It is beneficial to the setting and balance optimization of the cutting structure of the drill bit and the hydraulic structure.

As an option, the cutting profile of the fixed cutting structure whose profile does not extend to the center of the drill bit is in an area outside ⅓ of the radius of the drill bit. The cutting contour of the fixed cutting structure is in the area outside the radius of the drill bit, which can make room for the core of the drill bit, which facilitates the design and optimization of water holes, nozzles and hydraulics. As a further option, the cutting contour of the fixed cutting structure whose contour does not extend to the center of the drill bit is in the area outside ½ of the drill bit radius, in the area outside ⅔ of the drill bit radius, in the area outside 80% of the drill radius.

As an option, a water hole is provided between the cone and the fixed cutting structure. As a further option, a water hole is provided between the cone and the front side surface of the fixed cutting structure, and a water hole is provided between the cone and the rear side surface of the fixed cutting structure. A water hole is arranged between the cone and the fixed cutting structure, which is beneficial to the migration and cleaning of cuttings generated on the cone and the fixed cutting structure, and the cooling of the cutting structure.

As an option, a nozzle is provided in the water hole. As a further option, a fixed nozzle may be provided on the water hole. As another option, the nozzle in the water hole is detachable (movable nozzle).

As an option, the outer row of the gauge teeth or (and) the back cone of the cone participates in the gauge protection. The outer row of the gauge teeth or (and) the back cone of the composite drill bit participates in the gauge protection. The drill bit has more gauge and gauge positioning points in the circumferential direction, and the impact and vibration during the rock-breaking transition between the bit cutting structures are smaller, the better the working stability, the better the orientation performance and the longer the service life.

The aforementioned main scheme of the present invention and each of its further alternatives can be freely combined to form multiple schemes, which are all schemes that the present invention can adopt and claim protection; and this invention, (non-conflicting options) among the options and other options, they can also be combined, which are all technical solutions to be protected by this invention, and are not exhaustively listed here.

DESCRIPTION OF ATTACHED FIGURES

REFERENCE SIGNS

1—drill bit body; 2—fixed cutting structure; 21—front side surface; 22—rear side surface; 3—the cone; 31—outermost tooth; 32—back cone; 4—nozzle.

SPECIFIC IMPLEMENTATION METHODS

The following non-limiting cases serve to illustrate the invention.

Figure 1:
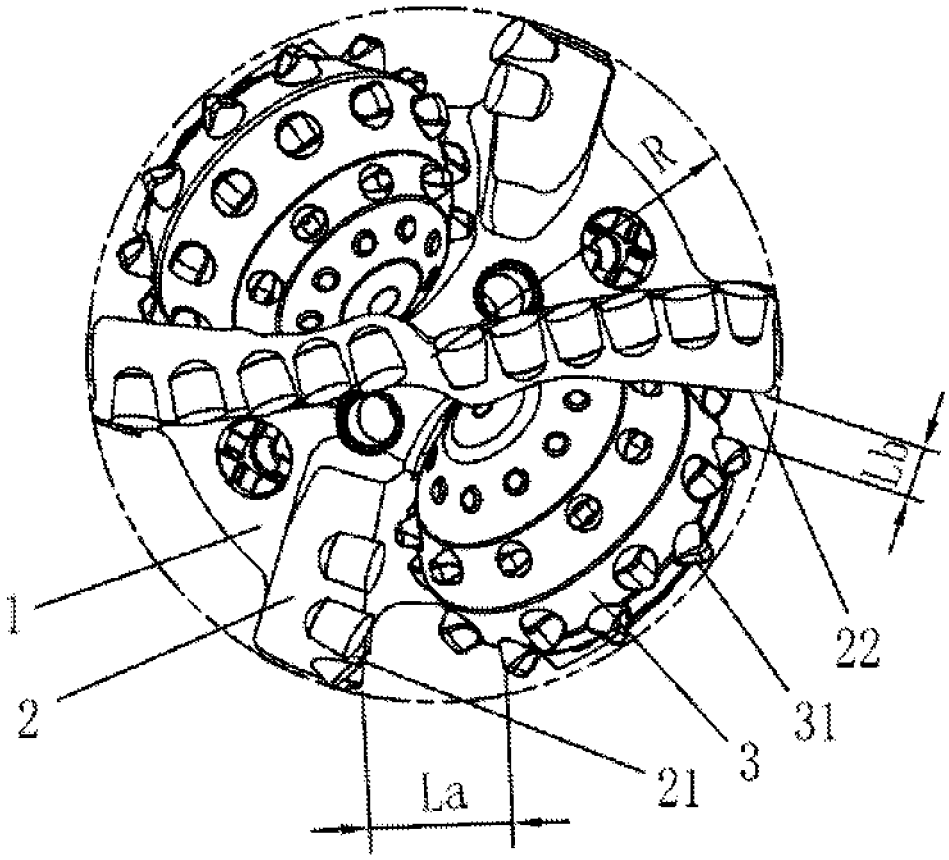
FIG. 1 is a top view schematic diagram of the structure of the drill bit when implementing case 1 and case 2 of this invention. The top view is the diagram from the cutting structure of the bit to the rear end of the bit along the drill bit axis.
Figure 2:
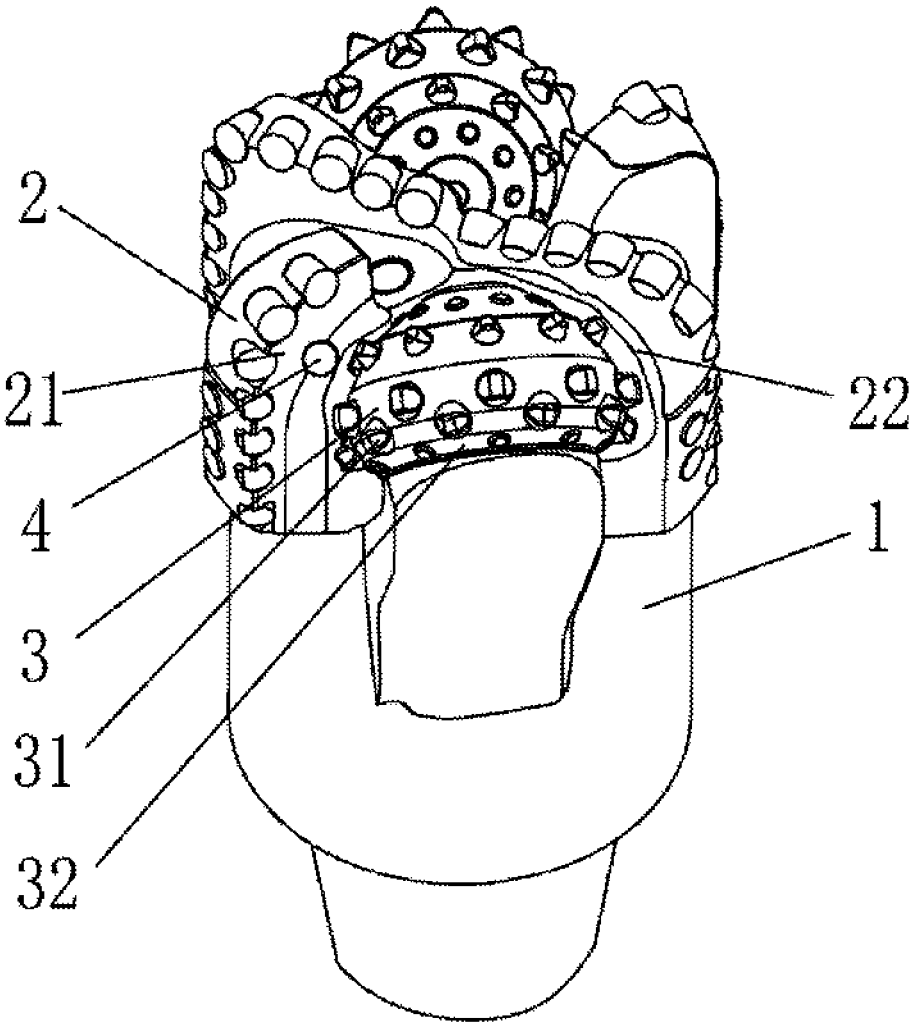
FIG. 2 is a schematic structural diagram of a general view of the drill bit when implementing cases 1 and 2 of this invention.

Case 1:

Referring to FIG. 1 and FIG. 2, a fixed cutting structure-composite cone drill bit includes a bit body 1, a fixed cutting structure 2 and at least one cone 3. The cone 3 and the fixed cutting structure 2 are disposed on the bit body 1. The cone 3 forms a rotational connection with the bit body 1 through a bearing structure, and the distance La from the outermost tooth (or outermost row of the tooth) 31 or back cone 32 of at least one cone to the front side surface 21 of the fixed cutting structure 2 is less than or equal to πR/3, that is, La πR/3, there is at least one outermost tooth (or outermost row of the tooth) 31 or back cone 32 of the cone. And the distance Lb from the rear side surface 22 of the fixed cutting structure 2 is less than or equal to πR/3, that is, Lb yπR/3 (R is the radius of the drill). As a further option, the distance La between the outermost tooth 31 or back cone 32 of the cone 3 and the font side surface 21 of the fixed cutting structure 2 is less than or equal to πR/4 (La≤πR/4), and less than or equal to πR/5 (La≤πR/S), less than or equal to πR/6 (La≤πR/6).

Preferably, the distance Lb between the outermost tooth 31 or back cone 32 of the cone 3 and the rear side surface 22 of the fixed cutting structure 2 is less than or equal to πR/4 (Lb≤πR/4), and less than or equal to πR/5 (Lb≤πR/), less than or equal to πR/6 (Lb≤πR/6).

As an option, the fixed cutting structure 2 is provided with fixed cutting teeth, and the fixed cutting teeth may be PDC cutters, PDC teeth, impregnated diamond bit teeth (or blocks), cubic boron carbide, ceramic teeth, hard alloy teeth, one or more of the composite teeth made of polycrystalline diamond and impregnated diamond.

As an option, the distance from the front side surface 21 to the outermost tooth (or outermost mw of the gauge teeth) 31 or back cone 32 of the cone is less than or equal to πR/3, πR/4, πR/5 or 7πR/6. The cutting profile of the cutting structure 2 does not extend to the center of the drill bit.

As an option, the cutting profile of the fixed cutting structure whose profile does not extend to the center of the drill bit is in an area outside ⅓ of the radius of the drill bit. As a further option, the cutting contour of the fixed cutting structure whose contour does not extend to the center of the drill bit is in the area outside ½ of the drill bit radius; in the area outside ⅔ of the drill bit radius; in the area outside 80% of the drill radius.

Case 2:

Basically, this case is the same as Case 1. Referring to FIG. 2, the difference is that a water hole 4 is provided between the cone 3 and the fixed cutting structure 2. As an option, a water hole is provided between the cone 3 and the front side surface 21 of the fixed cutting structure 2 or (and) a water hole is provided between the cone 3 and the rear side surface 22 of the fixed cutting structure 2. A water hole 4 is arranged between the cone 3 and the fixed cutting structure 2 to facilitate the migration and cleaning of the cuttings generated on the cone 3 and the fixed cutting structure 2, as well as the cooling of the cutting structure. As an option, a nozzle 4 is provided in the water hole. As a further option, a fixed nozzle may be provided on the water hole 4. As another option, the nozzle 4 in the water hole is detachable (movable nozzle).

Case 3:

Basically, this case is the same as Case 1, and the difference is that the outer row of the gauge teeth 31 or (and) the back cone 32 of the cone 3 participates in the gauge protection. The outer row of the gauge teeth 31 or (and) the back cone 32 of the composite drill bit participates in the gauge protection. The drill has more gauge and gauge positioning points in the circumferential direction, and the impact and vibration during the rock-breaking transition between the bit cutting structures are smaller. The better the working stability of the drill bit, the better the orientation performance, and the longer the service life.

The above descriptions are only preferred cases of the present invention and are not intended to limit this invention. Any modification, equivalent replacement, and improvement made within the spirit and principle of this invention shall be included in the scope of protection of this invention.

The invention claimed is:

1. A fixed cutting structure-composite cone drill bit, comprising:

a bit body that has an end surface that is circular in shape;

a first fixed blade extending across a center of the end surface of the bit body;

a second fixed blade and a third fixed blade disposed on each side of the first fixed blade without contacting the first fixed blade, respectively, wherein each of the first fixed blade, the second fixed blade, and the third fixed blade comprises a plurality of cutters installed thereon; and a first roller cone and a second roller cone disposed on the end surface of the bit body, wherein the first roller is disposed between the first fixed blade and the second fixed blade and the second roller is disposed between the first fixed blade and the third fixed blade, and each of the first roller cone and the second roller cone is connected to the bit body through a bearing structure to form a rotary connection, wherein a distance La between an outermost tooth or a back surface of the first roller cone and a front side surface of the second fixed blade is less than or equal to $\pi R/3$ so that $La \leq \pi R/3$, at least the distance Lb from the outermost tooth or a back surface of the first roller cone to a rear side surface of the first fixed blade is less than or equal to $\pi R/3$ so that $Lb \leq \pi R/3$, R is the radius of the drill, and wherein an apex of each of the first roller cone and the second roller cone points inwardly to a center of the drill bit.

2. The fixed cutting structure-composite cone drill bit according to claim 1, wherein the distance La is less than or equal to $\pi R/4$.

3. The fixed cutting structure-composite cone drill bit according to claim 1, wherein the distance La is less than or equal to $\pi R/5$.

4. The fixed cutting structure-composite cone drill bit according to claim 1, wherein a cutting profile of the second fixed blade or the third fixed blade does not extend to the center of the drill bit.

5. The fixed cutting structure-composite cone drill bit according to claim 4, wherein the cutting profile of the second fixed blade or the third fixed blade resides in an area outside ⅓ of the radius of the drill bit.

6. The fixed cutting structure-composite cone drill bit according to claim 5, wherein the cutting profile of the second fixed blade or the third fixed blade resides in an area outside ½ of the radius of the drill bit.

7. The fixed cutting structure-composite cone drill bit according to claim 6, wherein the cutting profile of the second fixed blade or the third fixed blade resides in an area outside ⅔ of the radius of the drill bit.

8. The fixed cutting structure-composite cone drill bit according to claim 7, wherein the cutting profile of the second fixed blade or the third fixed blade resides in an area outside 80% of the radius of the drill bit.

9. The fixed cutting structure-composite cone drill bit according to claim 1, wherein a water hole is provided between the cone and the fixed cutting structure.

10. The fixed cutting structure-composite cone drill bit according to claim 1, wherein, during drilling, Hall an outer row of the gauge teeth of each of the first roller cone and the second roller cone are operable to maintain gauge.

* * * * *